US008418619B1

(12) United States Patent
Phillips

(10) Patent No.: US 8,418,619 B1
(45) Date of Patent: Apr. 16, 2013

(54) KINEMATIC COUNTERMEASURE

(75) Inventor: Alan Phillips, Toone, TN (US)

(73) Assignee: Kilgore Flares Company, LLC, Toone, TN (US)

( * ) Notice: Subject to any disclaimer, the term of this patent is extended or adjusted under 35 U.S.C. 154(b) by 9 days.

(21) Appl. No.: 13/080,771

(22) Filed: Apr. 6, 2011

Related U.S. Application Data

(63) Continuation-in-part of application No. 12/348,104, filed on Jan. 2, 2009, now abandoned.

(60) Provisional application No. 61/018,694, filed on Jan. 3, 2008.

(51) Int. Cl.
*F42B 4/26* (2006.01)
*F42B 12/36* (2006.01)

(52) U.S. Cl.
USPC ..... 102/336; 102/341; 102/347; 102/352; 102/360; 102/282; 102/291

(58) Field of Classification Search ..... 102/335, 102/336, 341, 342, 345, 346, 347, 351, 352, 102/357, 360, 361, 374, 376, 282, 291
See application file for complete search history.

(56) References Cited

U.S. PATENT DOCUMENTS

| | | | | |
|---|---|---|---|---|
| 4,340,197 | A * | 7/1982 | Campbell | 244/3.1 |
| 5,074,216 | A * | 12/1991 | Dunne et al. | 102/334 |
| 7,908,972 | B2 * | 3/2011 | Brunn | 102/458 |
| 8,191,478 | B2 * | 6/2012 | Herbage et al. | 102/352 |
| 2011/0168047 | A1 * | 7/2011 | Hahma | 102/347 |

* cited by examiner

*Primary Examiner* — James Bergin
(74) *Attorney, Agent, or Firm* — Wyatt, Tarrant & Combs, LLP; H. Roy Berkenstock

(57) ABSTRACT

The present invention provides an improved kinematic countermeasure flare and method of constructing the same wherein the housing has integrated internal features. The flare nose weight is set at the end of a die core prior to molding for integration with the housing. Longitudinal grooves and other recesses in the die core allow for the formation of internal longitudinal ribs which propellant can bond to and a retaining bead for retaining the nose weight in the housing which are integrated with the housing. Propellant is cast into the formed housing. A propellant shaping mandrel is then inserted into the formed housing thereby forcing the propellant into the internal cavity created by the integrally molded longitudinal ribs, the shaping mandrel and the wall of the flare housing such that the propellant is bonded to the interior housing wall and the longitudinal ribs. This improved housing and method of construction eliminates the need to apply a non-flammable coating to propellant surfaces after its addition to the flare housing which a an imprecise and time consuming process.

9 Claims, 3 Drawing Sheets

KINEMATIC COUNTERMEASURE

RELATED APPLICATIONS

This application is a continuation-in-part of and claims priority of U.S. patent application Ser. No. 12/348,104 filed on Jan. 2, 2009 which is a non-provisional of and claims priority of U.S. patent application Ser. No. 61/018,694 filed on Jan. 3, 2008, both of which are hereby incorporated by reference.

STATEMENT REGARDING SPONSORED RESEARCH OR DEVELOPMENT

Not applicable.

REFERENCE TO A MICROFICHE APPENDIX

Not applicable.

FIELD OF THE INVENTION

The present invention is related to the manufacture of countermeasure flares, and particularly an improved housing assembly facilitating the manufacture of flares.

BACKGROUND OF THE INVENTION

The present invention relates to a flare housing. The invention is directed to an improved interior structure which facilitates the manufacturing of the flare as well as improving the reliability and performance of the flare.

Aerial flares are used for such as illumination, signaling, marking, decoys, military countermeasures and the like. A flare is typically described as a pyrotechnic device designed to produce a luminous display or illumination. Due to the nature of uses, aerial flares require a high degree of reliability in their performance. When the flare is ignited for either decoy or illumination, it is imperative that it perform, or burn as designed, or its objective will not be realized.

In the area of countermeasures, flares are now designed to defeat the most sophisticated heat-seeking missiles. Unlike earlier versions of decoy flares which were dropped from aircraft like "hot bricks", these new infrared flare countermeasure devices are self propelled kinematic flares. Current flare housings are usually a cylindrical can, open at one end. Current kinematic flare housings are typically of a composite construction made from a reinforced resin material that is manufactured by forming resin impregnated reinforcing material over a die core, placing the formed material/die core into a mold, and applying heat/pressure to form and cure the material thereby creating the housing. The formed and cured housing is removed from its mold and the die core removed rendering the housing ready for the next steps in the flare production.

The decoy flare is built-up inside of the walls of the formed housing, first including a nose weight at the head, or closed end of the housing. The nose weight is fixed securely into position, to prevent it from coming loose and interrupting the flight-path of the flare. In certain designs, the nose weight is bonded and cured to the inside surfaces of the closed end of the flare housing with an adhesive. This is a time consuming and imprecise process due to the challenges associated with applying adhesive on the interior wall at the forward end of a formed housing with a generally small interior. For example, the dimensions of the aft end opening of one such housing is about 1.5 inches by 2 inches and the housing is about 8 inches in length. The propellant is blended and then cast into the formed housing. A propellant shaping mandrel having certain longitudinal grooves for receiving propellant is plunged into the cast propellant forcing it up around the shaping mandrel and into the longitudinal grooves. The mandrel is then fixtured in place and the propellant is then cured. Once the solid propellant is cured, the shaping mandrel is removed from the assembly. Located in the cast propellant are specific cross-sectional voids created by the propellant shaping mandrel.

The cast propellant is the energetic or pyrotechnic material creating the required thrust upon ignition. Upon ignition, the exposed surface of the propellant burns. The burn rate/pressure profile can be controlled by limiting the area of the surface that is exposed. During construction of the flare, after the propellant is added to the housing and allowed to cure, a layer of non-flammable material such as an epoxy or similar material, is applied to a portion of the exposed surfaces of the propellant and allowed to cure. The propellant surfaces coated with the non-flammable material are thus inhibited from burning and the desired control of the burn/pressure profile is achieved. For example, a layer of non-flammable material may be thickly painted on the side edges or some portion of the side edges of the propellant or extruded from a nozzle in a thick bead of material alongside the propellant analogous to laying a bead from a calking nozzle. In the prior art, this non-flammable coating is applied, essentially blindly along the propellant grain. Likewise in the prior art, the nose weight is secured in position to the closed end of the housing with an adhesive which is painted on or applied in a bead. Given the manual application of the non-flammable coating, and the necessity of applying the coating on the exposed propellant surface after the propellant is bonded to the interior of the housing, the placement is time consuming and not always precise.

To complete the construction of the flare, a threaded stud is affixed approximately in the center of the nose weight such that it protrudes into the interior of the housing for receiving and holding in place the flare grain. The flare grain is inserted into the void in the housing created by the propellant shaping mandrel and is axially aligned with the housing. The propellant is intermediate the housing and flare grain. A nozzle is affixed to the aft end of the housing for propulsion of the countermeasure flare.

The present invention facilitates the manufacture of the countermeasure, as well as providing more precise way to inhibit the burn rate/pressure profile exhibited by the flare and ensuring accurate placement of the nose weight and other internal features of the decoy.

SUMMARY OF THE INVENTION

Accordingly, it is an object of the present invention to provide an improved kinematic countermeasure flare and method of constructing the same wherein the housing is of a built-up construction wherein the nose weight is set at the end of the die core prior to the lay-up and molding/curing of the housing. Housing material, such as resin impregnated reinforcing material, is formed over the die core and nose weight and placed in a mold. Those of skill in the art will recognize that other light weight, heat resistant, non-flammable materials are suitable for the housing material.

Longitudinal grooves and other recesses in the die core allow for the formation of internal longitudinal ribs which propellant can bond to and a retaining bead for retaining the nose weight in the housing which are integrated with the housing. Additionally, the longitudinal ribs act as supports for the nose weight and hold it in position. During the lay-up process, housing material is formed over the die's core and nose weight, including forcing housing material into the grooves and recessed in the die mold. In one embodiment, a strip of housing material may be placed about the circumference of the die core and nose weight assembly such that it is intermediate the die core and nose weight. During molding, housing material is cast into the grooves and recesses of the die core where it is allowed to cure thereby forming longitudinal ribs and a nose weight retaining bead all of which are internal to and integrated with the housing. Once the molding process is complete and the die core removed from the housing, the molded integral nose weight retaining bead and the forward ends of the molded integral longitudinal ribs retain the nose weight in position. Additionally, the molding process bonds the forward surface of the nose weight to cured reinforced resin material of the housing.

Propellant is cast into the formed housing and a propellant shaping mandrel is then inserted into the formed housing thereby forcing the propellant into the internal cavity created by the integrally molded longitudinal ribs, the shaping mandrel and the wall of the flare housing such that the propellant is bonded to the interior housing wall and the longitudinal ribs. Once the propellant has cured, the shaping mandrel is removed. The integrally molded longitudinal ribs, which protrude into the internal cavity of the housing, form surfaces for the cast propellant to bond to during this propellant casting/curing process. The longitudinal ribs effectively reduce the exposed surface area of the propellant thereby controlling the burn rate/pressure profile of the propellant and thus eliminating the need to apply a non-flammable coating to those surfaces after the propellant is cast in place. Likewise, the integrated nose weight is held more securely in place by this improved manufacturing process.

In an alternate construction, the housing may be produced by injection molding with the nose weight insert molded in the housing and the nose weight retaining bead and the longitudinal rib features generated by the molding die and the die core during the injection molding process. In yet another alternative construction, the internal ribs and/or retaining bead are fabricated separately from the housing and insert molded in the housing during an injection molding process.

To complete the construction of the flare, the flare grain is inserted into the void in the housing created by the propellant shaping mandrel and is axially aligned with the housing. The propellant is intermediate the housing and flare grain. A nozzle is affixed to the aft end of the housing for propulsion of the countermeasure flare.

Various refinements exist of the features noted in relation to one or more of the above-described aspects of the present invention. Further features may also be incorporated into one or more of those aspects as well. These refinements and additional features may exist individually or in any combination. For instance, the various features discussed below in relation to the illustrated embodiments may be employed in any of those aspects, individually or in any combination.

DETAILED DESCRIPTION OF PREFERRED EMBODIMENTS

Figure 1:
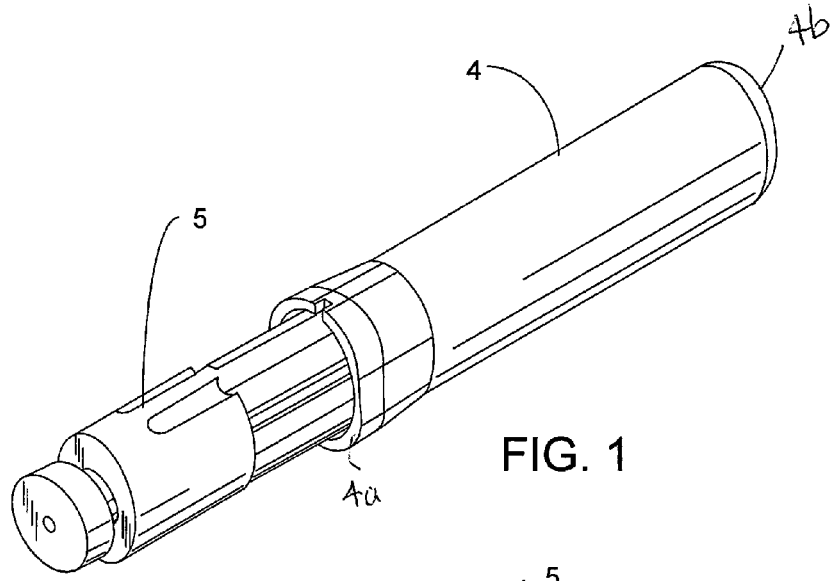
FIG. 1 is an end view of the countermeasure housing of the present invention.

The present invention will now be described in relation to the accompanying drawings, which at least assist in illustrating the various pertinent features thereof. FIG. 1 shows an aft end view of the present invention wherein a generally tubular countermeasure housing 4 has disposed therein a propellant shaping mandrel 5 composed of aluminum or other suitably rigid material. The shaping mandrel 5 is used in the manufacturing process during the addition of the propellant to the formed housing 4. The housing 4 has an open aft end 4*a* and a closed forward end 4*b*. In one embodiment, the housing 4 is generally cylindrical.

Figure 5:
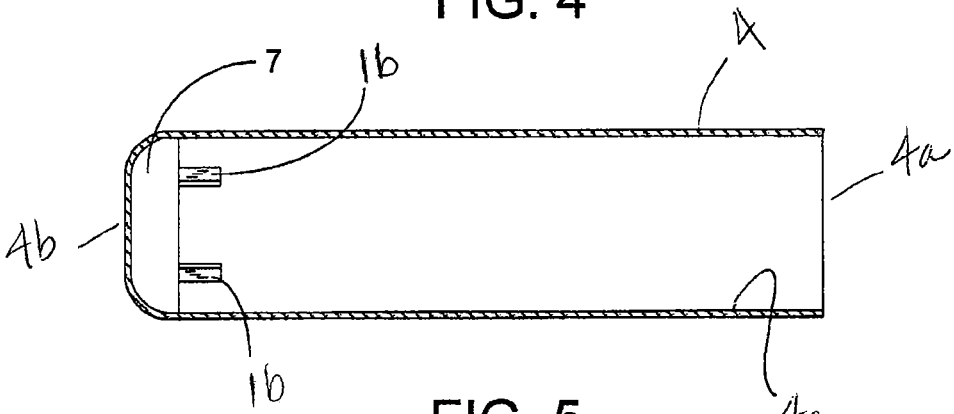
FIG. 5 is a cross sectional view of an alternative embodiment of the housing according to the present invention.
Figure 7:
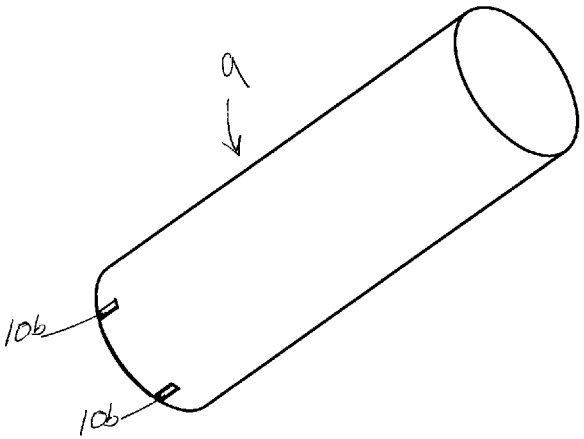
FIG. 7 is an end view of the opposite side of the die core of FIG. 6.
Figure 6:
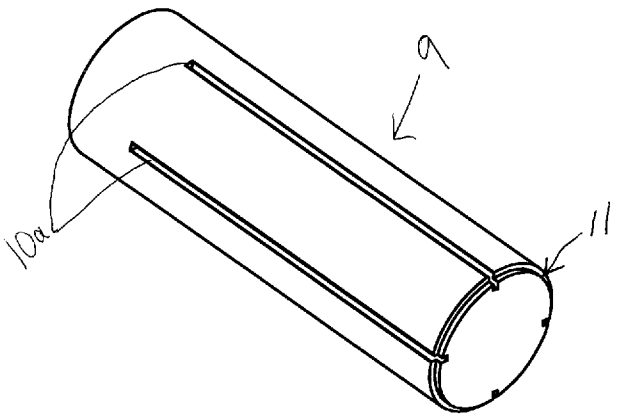
FIG. 6 is an end view of one side of the die core used to manufacture the housing in one embodiment of the present invention.
Figure 9:
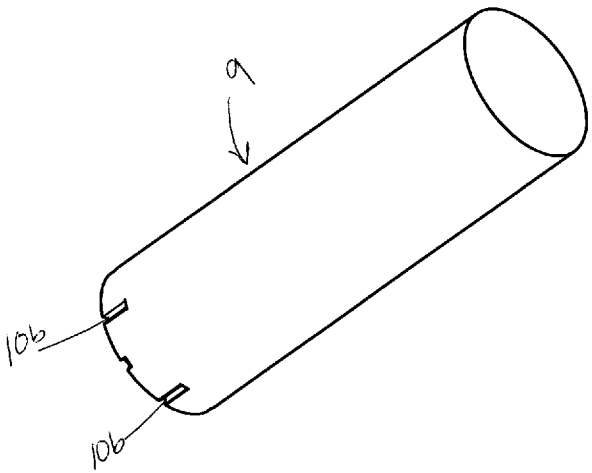
FIG. 9 is an end view of the opposite side of the die core of FIG. 8.
Figure 8:
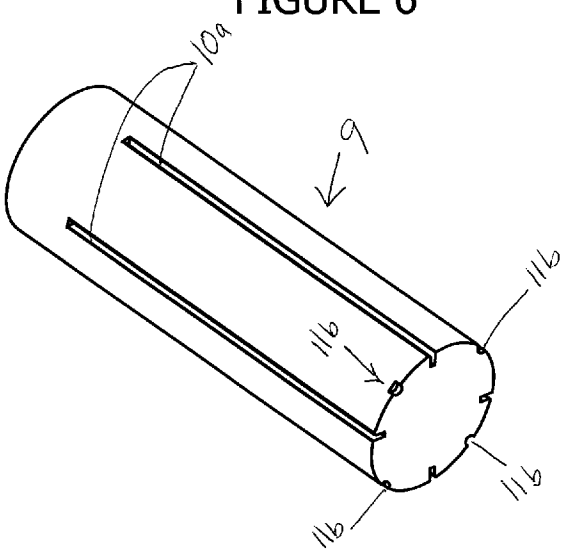
FIG. 8 is an end view of one side of the die core used to manufacture the housing in an alternative embodiment of the present invention.

Referring now to FIGS. 6, 7, 8, and 9, a die core 9 used in the fabrication of the housing 4 is shown. The die core 9 has at least one longitudinal groove 10 for forming at least one longitudinal rib 1 (See FIG. 3) integrated with the interior housing wall 4*c*. The dimensions of the longitudinal grooves 10 are chosen based on the amount of propellant surface area which should be exposed in order to produce the desired burn rate/pressure profile when the flare is ignited. The longitudinal grooves 10, and therefore the longitudinal ribs 1 formed therefrom, may be of different dimensions within the same housing. For example, FIGS. 6 and 8 show longitudinal grooves 10*a* extending substantially the length of the die core for forming longitudinal ribs 1*a* of the same length (See FIG. 3). Likewise, FIGS. 7 and 9 show the opposite sides of the die core 9 having shorter longitudinal ribs 10*b* for forming shorter longitudinal ribs 1*b* (See FIGS. 4 and 5)

Referring now to FIGS. 6 and 8, a recess 11 in the die core 9 is used to form the retaining bead 3. FIG. 6 shows a continuous recess 11*a* surrounding the forward end of the die core 9 for forming one continuous retaining bead 3. Alternatively, as shown in FIG. 8, multiple recesses 11*b* are located about the circumference of the die core 9 for forming a series of integrated retaining beads 3 about the circumference of the interior housing wall 4 in sufficient quantity to ensure that the nose weight 7 remains in place during combustion and flight of the flare.

Figure 2:
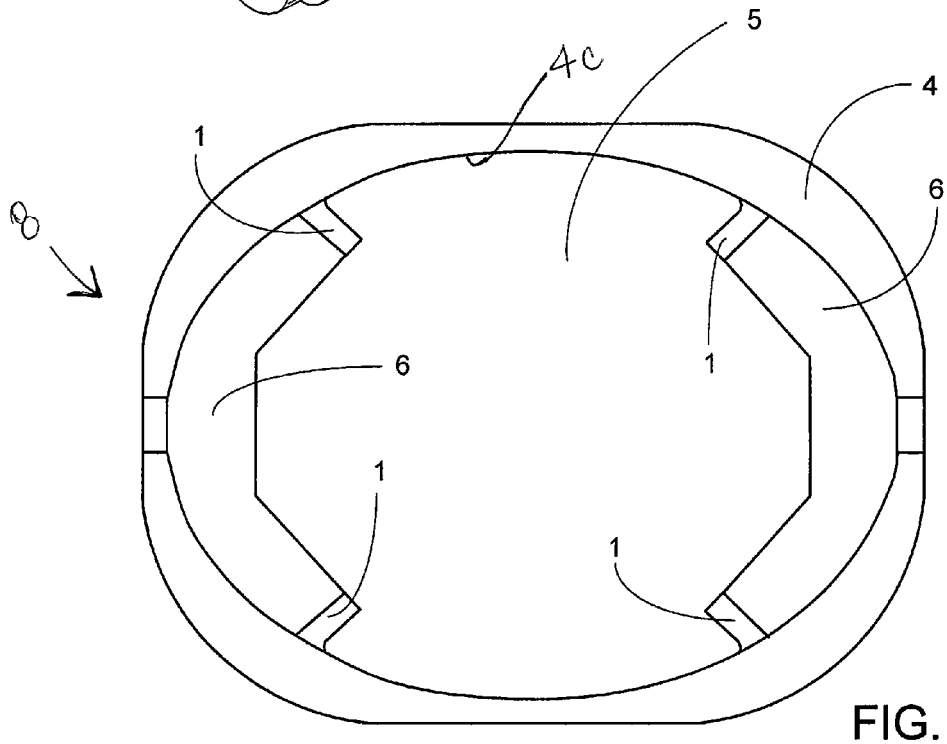
FIG. 2 is a cross-section view of a countermeasure housing with the propellant shaping mandrel inserted, having placed therein the propellant of the countermeasure.

FIG. 2 shows a cross section of an aft end view of the countermeasure housing of the present invention with the mandrel inserted, including the propellant 6. Interior longitudinal ribs 1 are integrated with the interior housing wall 4*c* and protrude into the housing 4 interior. The ribs 1 are affixed about the circumference of the housing 4. Upon insertion of a propellant shaping mandrel 5 (See also FIG. 1) into the aft end of the housing 4*a* during fabrication of the countermeasure 8, the ribs 1, interior housing wall 4*c*, and shaping mandrel 5 form at least one cavity for receiving propellant 6 during the propellant casting process. Referring now to FIG. 2, propellant 6 is affixed to portions of the interior housing wall 4*c* about the circumference of the housing 4 between longitudinal ribs 1. The propellant 6 is bonded to the interior wall 4*c* and ribs 1 during the propellant casting and curing process thereby limiting the surface area of the propellant 6 that is exposed and inhibiting the burn rate of the propellant 6. FIG. 2 shows the shaping mandrel 5 inserted into the formed housing 4 for the propellant casting step. When finally assembled, the flare grain (not shown) is situated in the void left in the housing 4 upon removal of the shaping mandrel, the flare grain axially aligned with the housing 4.

Figure 3:
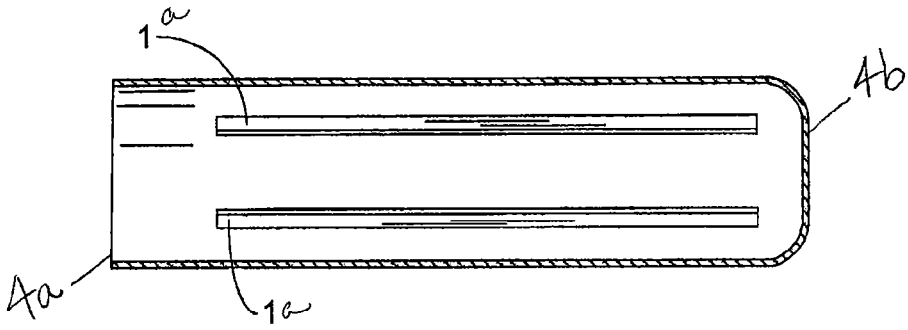
FIG. 3 is a cross-sectional view of one embodiment of a countermeasure housing according to the present invention.

FIG. 3 illustrates a longitudinal, cross sectional view of housing 4 having axial ribs 1*a* disposed over a significant longitudinal extent (as about 50 to about 80 percent) of the length of the housing 4. Those of skill in the art will recognize that the dimensions and number of ribs 1 will vary depending on the desired thrust envelope to be exhibited by the countermeasure. The geometry of the propellant 6, and likewise the dimensions and number of the ribs 1 and therefore the amount of propellant exposed, varies for different countermeasures depending on the desired burn rate/pressure profile to be exhibited by the countermeasure upon ignition and on the desired thrust envelope (thrust versus time) to be achieved by the flare. In one embodiment as shown in FIG. 3, the longitudinal ribs 1*a* extend longitudinally along the interior wall of the housing 4*c* and terminate just before the nose weight thereby acting as supporting members which hold the nose weight in place. Shorter longitudinal ribs 1*b* are included in some embodiments as show in FIGS. 4 and 5. In other embodiments, both the longitudinal ribs 1 integrated within the same housing 4 are of varying lengths.

Figure 4:
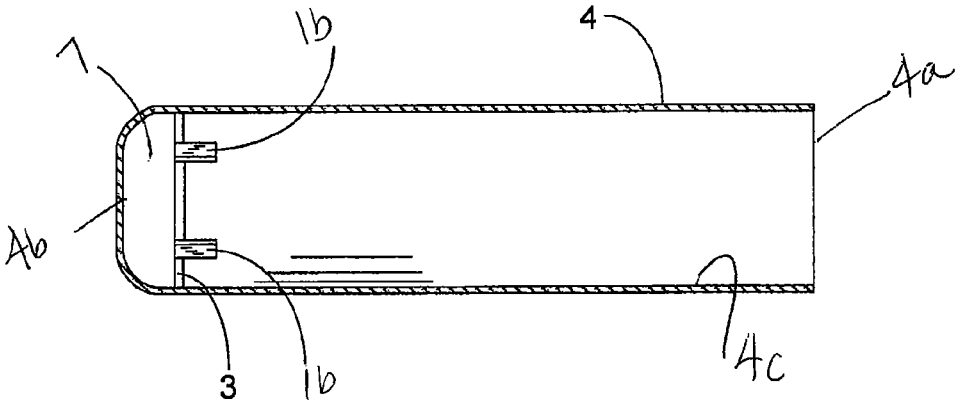
FIG. 4 is a cross-section view of an alternative embodiment of the housing according to the present invention.

Referring now to FIGS. 4 and 5, a nose weight 7 is disposed inside the housing 4 at the forward end 4*b*. The nose weight 7 is affixed to the interior of the forward end of the housing 4*b* during the casting and curing process. The nose weight 7 is further secured to the housing 4 by a retaining bead 3 which is integrated into the housing and formed during the casting and curing process. The retaining bead 3 protrudes into the interior of the housing and is positioned about the circumference of the interior housing wall 4*c* just above the nose weight 7. The retaining bead may be one continuous bead or may be a series of beads which are integrated about the circumference of the interior housing wall 4 in sufficient quantity to ensure that the nose weight remains in place during combustion and flight of the flare. Those of skill in the art will recognize that there are many ways to integrated the retaining bead 3 into the housing 4. For example, during fabrication of the housing 4, a strip of housing material is placed about the circumference of the die core 9 and nose weight 7 assembly and positioned intermediate the nose weight 7 and the forward end of the die core 9. Alternatively, housing material is inserted into at least one recess 11 in the die core 9 during the lay-up process. (See FIGS. 6, 7, 8 and 9).

The improved kinematic countermeasure of the present invention having integrated, burn inhibiting ribs 1 and an integrated nose weight 7 of the present invention can be fabricated as follows. A die core 9 having appropriate longitudinal grooves 10 for forming integrated longitudinal ribs 1 is selected. The die core 9 may also have appropriate recesses 11 for forming the retaining bead 3, if needed. The nose weight 7 is set at the forward end of the die core 5. A reinforcing housing material such as resin impregnated reinforcing material, for example in strips, is inserted into the grooves 10 and recesses 11, if applicable, of the die core 9. A reinforcing housing material such as resin impregnated reinforcing material or fiber cloth made, for example, of glass, arimid or carbon fiber for structural integrity, is formed around the nose weight 7 and die core 9 assembly before the assembly is placed in the mold. The housing material is chosen from those having the cured strength and temperature resistance to withstand operating temperatures and pressures of the finished countermeasure.

In some embodiments, housing material, for example in a strip, is wrapped around the circumference of the die core 9 and nose weight 7 assembly above the nose weight 7 during the lay-up process for forming into the retaining bead 3 during casting. The wrapped die core 9 and nose weight 7 assembly is inserted into the mold for casting and curing. During casting, the housing material is formed into the housing 4. The housing material in the grooves 10 and recesses 11 of the die core 9 forms the integrated ribs 1 and retaining bead 3 during casting and curing. In another embodiment, injection molding is used to form the housing.

In yet another embodiment, the housing 4 and its components are insert molded. The nose weight 7 is inserted into the mold followed by the die core 9 and the housing 4 is cast in the mold. Reinforcing fibers may be added to the housing material prior to addition to the mold. The housing material in the grooves 10 and recesses 11 of the die core form the integrated ribs 1 and retaining bead 3 during casting and curing. In another embodiment, the longitudinal ribs 1 and retaining bead 3 are prefabricated and inserted into the mold. The ribs 1 are inserted such that they will protrude into the housing interior upon formation of the housing 4 during the molding process. When the housing material is added to the mold, the prefabricated ribs 1 and retaining bead 3 are bonded to the interior housing wall 4*c*.

Once the housing is cured, the die core 9 is removed. The ribs 1 protrude into the interior of the housing 4. The retaining bead 3 is integrated with the housing interior wall 4*c* above the nose weight 7. The nose weight 7 is retained at the housing forward end 4*b* by the retaining bead 3 and longitudinal ribs 1.

Propellant is blended and then cast into formed housing. A propellant shaping mandrel 5 is inserted into the formed housing 4 and propellant 6 thereby forcing propellant 6 into the at least one cavity created between the housing interior wall 4*c*, the longitudinal ribs 1, and the shaping mandrel 5. (See FIG. 2 showing propellant 6 in a cavity) The propellant 6 is allowed to cure. The shaping mandrel 5 is removed after the propellant has cured. The propellant 6 is bonded to the interior wall 4*c* and ribs 1 during this propellant casting and curing process thereby limiting the surface area of the propellant 6 that is exposed and inhibiting the burn rate of the propellant 6 (See FIG. 2). The longitudinal ribs 1 effectively reduce the exposed surface area of the propellant 6 thereby controlling the burn rate/pressure profile of the propellant 6 and thus eliminating the need to apply a non-flammable coating to those surfaces after the propellant 6 is cast in place. Likewise, the integrated nose weight 7 is held more securely in place by this improved manufacturing process. It is estimated that by eliminating the application of adhesive and non-flammable coating to the already formed interior of the housing, this improved method reduces manufacturing time by about 10%. Additionally, a less skilled work force is needed for the manufacturing method of the present invention. Likewise, improved quality is achieved by the improved process of the present invention.

To complete the construction of the flare, the flare grain (not shown) is inserted into the void in the housing 4 created by the propellant shaping mandrel 5 (See FIG. 2 showing inserted mandrel 5) and is axially aligned with the housing 4. The propellant 6 is intermediate the interior housing wall 4*c* and flare grain. (See FIG. 2 showing inserted mandrel 5) A nozzle (not shown) is affixed to the aft end of the housing 4 for propulsion of the countermeasure flare.

Those skilled in the art will appreciate that certain modifications can be made to the system and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

What is claimed is:

1. A kinematic countermeasure housing comprising:

a generally tubular countermeasure housing having a closed forward end, an open aft end, and an interior wall, the closed forward end and interior wall forming an interior of the housing;

a nose weight integrated with the interior housing wall having a forward end and an aft end; the forward end affixed to the interior wall at the forward end of the housing;

a retaining bead integrated with the interior housing wall and disposed generally circumferentially about the interior wall of the housing; said retaining bead adjacent the aft end of the nose weight and protruding into the interior of the housing such that the retaining bead holds the nose weight in place; and at least one longitudinal rib for bonding with a propellant, the at least one rib integrated with the interior housing wall and protruding into the housing interior.

2. The kinematic countermeasure housing of claim 1 wherein:

the at least one rib extends along the length of the interior wall from the aft end of the housing to the aft end of the nose weight.

3. The kinematic countermeasure housing of claim 1 further comprising:

a propellant disposed about a portion of the interior housing wall adjacent the at least one rib and bonded to the interior wall and at least one rib thereby limiting the exposed surface area of the propellant and inhibiting the burn rate of the propellant.

4. The kinematic countermeasure housing of claim 1 further comprising:

at least two longitudinal ribs wherein a first rib extends along the length of the interior wall from the aft end of the housing to the aft end of the nose weight and a second rib has a length that is shorter than the first rib.

5. A kinematic countermeasure comprising:

a generally tubular countermeasure housing having a closed forward end, an open aft end, and an interior wall, the closed forward end and interior wall forming an interior of the housing;

a nose weight integrated with the interior housing wall having a forward end and an aft end; the forward end affixed to the interior wall at the forward end of the housing;

a retaining bead integrated with the interior housing wall and disposed generally circumferentially about the interior wall of the housing; said retaining bead adjacent the aft end of the nose weight and protruding into the interior of the housing whereby the retaining bead holds the nose weight in place; and at least one longitudinal rib for bonding with a propellant, the at least one rib integrated with the interior housing wall and protruding into the housing interior, the at least one rib extending along the length of the interior wall.

6. The kinematic countermeasure of claim 5 further comprising:

a propellant disposed about a portion of the interior housing wall adjacent the at least one rib and bonded to the interior wall and at least one rib thereby limiting the exposed surface area of the propellant and inhibiting the burn rate of the propellant.

7. The kinematic countermeasure of claim 6 further comprising:

a flare grain disposed inside and axially aligned with the housing, the propellant intermediate the flare grain and the interior wall.

8. The kinematic countermeasure of claim 7 further comprising:

a nozzle affixed to the open aft end of the housing for propulsion of the countermeasure.

9. The kinematic countermeasure of claim 5 further comprising:

at least two longitudinal ribs wherein a first rib extends along the length of the interior wall from the aft end of the housing to the aft end of the nose weight and a second rib has a length that is shorter than the first rib.

* * * * *